US006374571B1

(12) United States Patent
Mann

(10) Patent No.: US 6,374,571 B1
(45) Date of Patent: Apr. 23, 2002

(54) INSULATION PANEL FOR CABINETS CONTAINING AIR HANDLING EQUIPMENT

(75) Inventor: Soren Mann, Orbyhus (SE)

(73) Assignee: Munters AB, Sollentuna (SE)

( * ) Notice: Subject to any disclaimer, the term of this patent is extended or adjusted under 35 U.S.C. 154(b) by 0 days.

(21) Appl. No.: 09/601,578

(22) PCT Filed: Feb. 2, 1999

(86) PCT No.: PCT/SE99/00133

§ 371 Date: Dec. 4, 2000

§ 102(e) Date: Dec. 4, 2000

(87) PCT Pub. No.: WO99/40374

PCT Pub. Date: Aug. 12, 1999

(30) Foreign Application Priority Data

Feb. 6, 1998 (SE) ..... 9800349

(51) Int. Cl.[7] ..... E04C 2/34

(52) U.S. Cl. ..... 52/783.1; 52/788.1; 52/787.1; 52/792.1; 52/792.11; 52/800.1; 52/404.4

(58) Field of Search ..... 52/144, 404.4, 52/783.1, 784.12, 784.16, 787.11, 787.1, 788.1, 792.1, 792.11, 800.1, 506.01; 312/296

(56) References Cited

U.S. PATENT DOCUMENTS

| | | | | | |
|---|---|---|---|---|---|
| 3,267,626 | A | * | 8/1966 | Daly | 52/784.12 |
| 3,420,032 | A | | 1/1969 | Felt | |
| 3,448,551 | A | * | 6/1969 | Heller | 52/127.12 |
| 3,540,116 | A | * | 11/1970 | Drahos et al. | 52/127.12 |
| 4,244,151 | A | * | 1/1981 | Seem | 52/60 |
| 4,316,351 | A | * | 2/1982 | Ting | 52/309.9 |
| 4,394,026 | A | * | 7/1983 | Kaiser et al. | 277/231 |
| 4,644,698 | A | * | 2/1987 | Gerdes et al. | 49/478 |
| 4,845,916 | A | * | 7/1989 | Villard | 52/802 |
| 4,850,176 | A | * | 7/1989 | Munsey et al. | 52/145 |
| 4,858,403 | A | * | 8/1989 | Lingle | 52/127.12 |
| 5,018,327 | A | | 5/1991 | Goebel et al. | |
| 5,170,550 | A | | 12/1992 | Cox et al. | |
| 5,285,609 | A | | 2/1994 | Goad | |
| 5,709,053 | A | * | 1/1998 | Kuroda | 52/145 |

FOREIGN PATENT DOCUMENTS

| | | |
|---|---|---|
| EP | 0127545 | 5/1984 |
| FR | 1358454 | 9/1964 |
| GB | 2280951 | 2/1995 |
| SE | 0318089 | 12/1969 |
| WO | 9424493 | 10/1994 |

* cited by examiner

*Primary Examiner*—Carl D. Friedman
*Assistant Examiner*—Phi Dieu Trana
(74) *Attorney, Agent, or Firm*—Dowell & Dowell, P.C.

(57) ABSTRACT

An insulation panel (1) for cabinets containing air handling equipment has an exterior housing section (2) and an interior housing section (3) which is joined to the exterior housing section by snap-in engagement means, preferably comprising a plurality of tabs (12) provided on the interior housing section. The tabs engage a flange (6) of the first housing section (2) via a first gasket (13), and a circumferential side wall (10) of the second housing section (3) abuts against the first housing section (2) via a resilient second gasket (14), whereby the tabs (12) abut against said first gasket under some pressure to firmly secure the first and second housing sections to each other without creating any thermal bridges between the housing sections.

9 Claims, 2 Drawing Sheets

INSULATION PANEL FOR CABINETS CONTAINING AIR HANDLING EQUIPMENT

Figure 1:
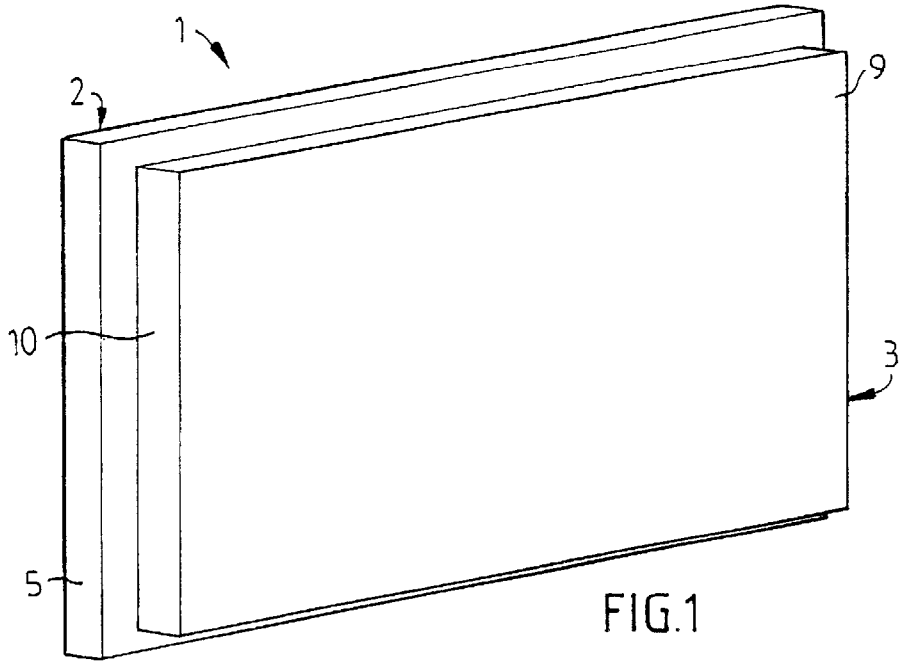

The present invention relates to an insulation panel for cabinets containing air handling equipment, comprising a first housing section, a second housing section joined to the first housing section to form a space therebetween, and insulation material provided in said space.

Known air handling cabinets are manufactured by securing a number of such insulation panels on a framework to form a closed insulated cabinet. The air handling equipment to be accommodated in the cabinet is typically air dehumidification equipment but may comprise any air treatment devices that need to be thermally insolated from the enviroment. Air treatment generally involves heat exchange and therefore it is important that the cabinet is efficiently thermally insulated, in order to provide high thermal efficiency and low energy losses of the equipment. As to the insulation panel, its insulation quality is enhanced if thermal bridges are avoided between the first housing section, which may be exposed to the exterior side of the cabinet, and the second housing section, which may be exposed to the interior of the cabinet. The housing sections are typically made of bent metal sheet of high thermal conductivity.

It is known Ito fabricate the insulation panel by bonding abutting metal flanges of the first and second housing sections by the use of epoxy glue, which gives rise to the disadvantage that a relatively extensive thermal bridge is developed along the glue joint. Another disadvantage in this connection is that the epoxy glue emits unhealthy volatile substances to the enviroment as the glue cures. The emission of such substances is subject to ever increasing restrictions from the authorities, which may limit the production of the panels at the production site.

GE Patent Application No. 2280951 discloses an insulation panel of the above discussed type, in which the housing sections are inter-connected by welding. As a result, an undesirable thermal bridge is developed along the welded seam between the housing sections.

FR Patent No. 1358454 discloses an insulation panel, in which two housing sections are joined together by snap-in engagement means.

A problem common to all known insulation panels is that they are relatively expensive and labour-intensive to fabricate. Since a cabinet may be composed of several relatively large insulation panels, it is desirable to reduce the fabrication costs of each panel. Furthermore, they are deficient because of the existense of undesirable thermal bridges.

The object of the present invention is to provide an insulation panel, which is relatively inexpensive to fabricate and which has an improved insulation quality, as compared with prior art panels.

This object is obtained by the insulation panel presented initially, which is characterized in that the first housing section forms chamber and has an annular flange defining an opening into said chamber, that the second housing section has a circumferential side wall inserted through said opening into said chamber to form said space between the first an second housing sections, that snap-in engagement means are arranged on the circumferential side wall of the second housing section and adapted to snap engage with the flange of the first housing section, when said circumferential side wall is inserted through said opening into said chamber, to join the first and second housing sections to each other, the snap-in engagement means engaging said flange via a first gasket, and that the circumferential side wall of the second housing section abuts against the first housing section via a resilient second gasket, whereby the snap-in engagement means abut against said first gasket under some pressure to secure the first and second housing sections to each other.

The provision of the snap-in engagement means and said first and second gaskets enables a design of the panel which minimizes or even eliminates thermal bridges between the housing sections.

In a preferred embodiment of the invention, the first housing section comprises a planar first front wall and a circumferential side wall extending substantially perpendicular to the first front wall, the annular flange extending inwardly from the side wall in parallel with the planar first front wall, and the second housing section comprises a planar second front wall, the circumferential side wall of the second housing section extending substantially perpendicular to the planar second front wall.

Suitably, the circumferential side wall of the second housing section abuts against the first front wall of the first housing section via said resilient second gasket.

The gaskets are suitably made from a material having low thermal conductivity, which essentially eliminates thermal bridges between the first and second housing sections.

Preferably, the resilient second gasket is provided with an adhesive for adhering to the exterior front wall of the first housing section and the side wall of the second housing section, which makes the panel strong and distortion resistant.

The snap-in engagement means comprise a plurality of snap-in engagement members distributed around the circumferential side wall of the second housing section. Each snap-in engagement member preferably comprises a tab which extends outwardly from the side wall of the second housing section. As an alternative, each snap-in engagement member may comprise a protrusion which projects outwardly from the side wall of the second housing section.

Figure 2:
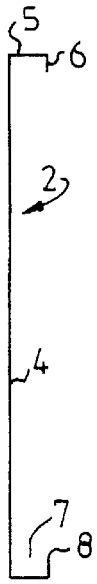
Figure 3:
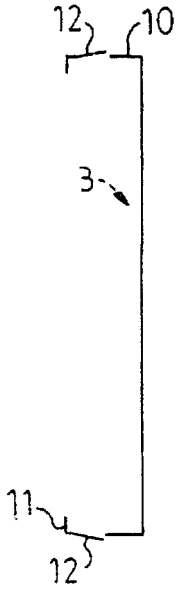
Figure 4:
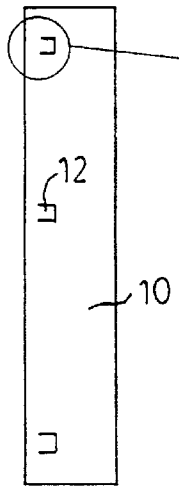
Figure 5:
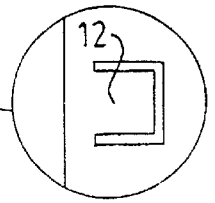
Figure 6:
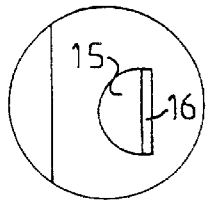
Figure 7:
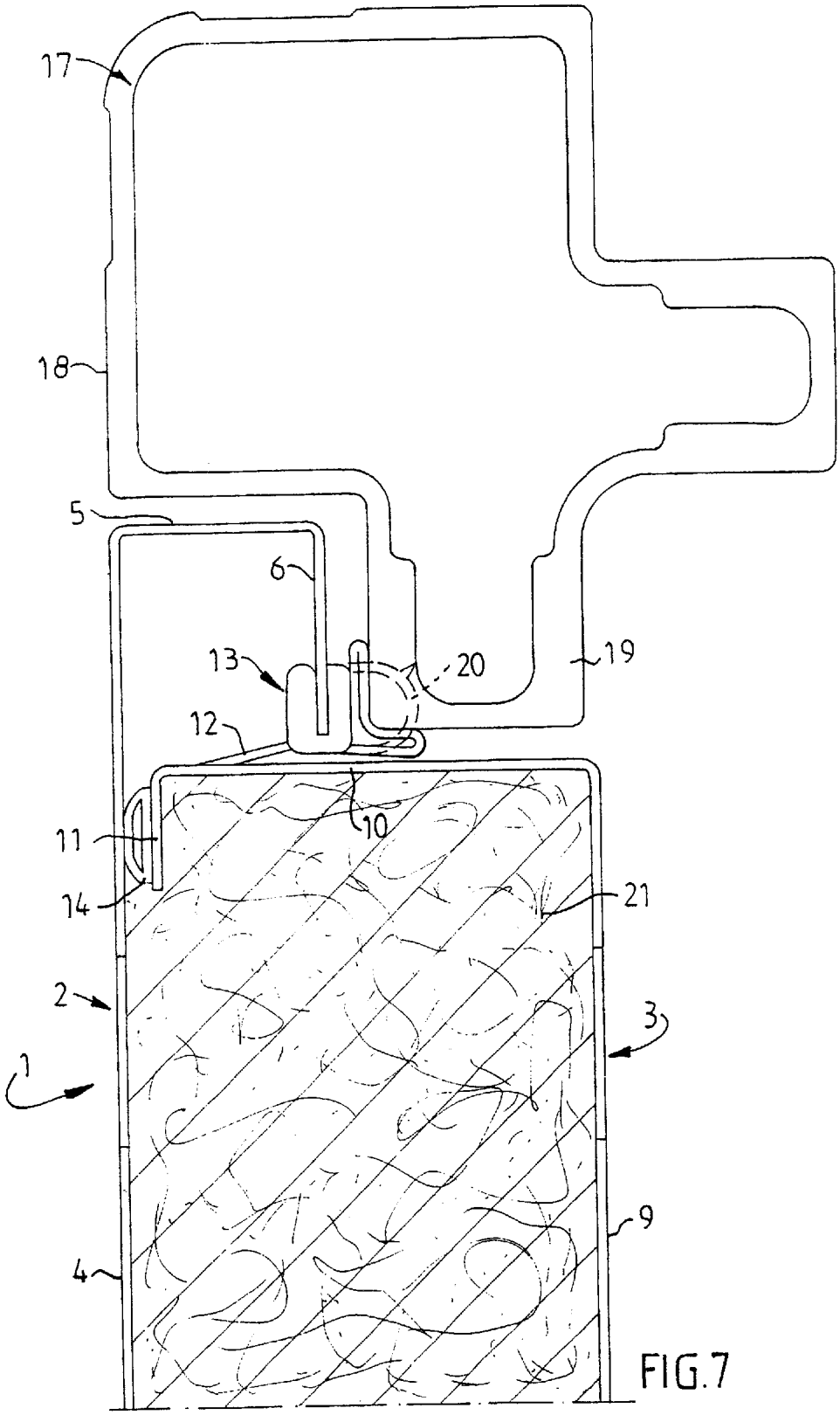

The invention is described in more detail in the following with reference to the accompanying drawings, in which FIG. 1 is a perspective view of a preferred embodiment of the insulation panel according to the invention, FIG. 2 is a schematic cross-section through an exterior housing section of the panel of FIG. 1, FIG. 3 is a schematic cross-section through an interior housing section of the panel of FIG. 1, FIG. 4 is a side view of the interior housing section of the panel of FIG. 1, FIG. 5 is a detail of the embodiment shown in FIG. 4, FIG. 6 is a modification of the embodiment shown in FIG. 5, and FIG. 7 is an enlarged cross-section through a part of the panel of FIG. 1 and a part of a framework onto which the panel is mounted.

In the figures there is shown an insulation panel 1 according to the invention comprising a rectangular exterior housing section 2 and rectangular interior housing section 3, both housing sections 2,3 being formed by bending steel sheets. The exterior housing section 2 has a rectangular planar front wall 4, a circumferential side wall 5 extending perpendicular to the front wall 4 and an annular flange 6 extending inwardly from the free edge of the side wall 5 in parallel with the planar front wall 4. The front and side walls 4,5 and the flange 6 form a chamber 7 having a rectangular opening 8 defined by the flange 6. The interior housing section 3 has a planar front wall 9, a circumferential side wall 10 and an annular flange 11 extending inwardly from the free edge of the side wall 10 in parallel with the planar front wall 9.

The side wall 10 of the interior housing section 3 has a rectangular cross-section and is sized to fit snugly into the rectangular opening 8 of the exterior housing section 2, so that the interior housing section 3 can be telescoped onto the exterior housing section 2 and form the assembled panel 1 shown in FIG. 1. To secure the housing sections 2 and 3 together, the interior housing section 3 is provided with snap-in engagement means in the form of tabs 12 on the side wall 10. Each tab 12 is formed by a U-shaped cut-out in the side wall 10, the U-shaped cut-out being oriented so that the free ends of the legs of the U are located close to the annular flange 11. As shown in FIG. 3 and 7, the tabs 12 are bent outwardly from the side wall 10 to the extent that the tabs 12 are able to snap ingage the annular flange 6 of the exterior housing section 2 when a predetermined portion of the interior housing section 3 is inserted into the chamber 7 of the exterior housing section 2. The side wall 5 and/or the side wall 10 are designed to yield somewhat when the interior housing section 3 is telescoped onto the exterior housing section 2 and the tabs 12 abut the edge of the flange 6, so that the tabs 12 are able to pass the opening 8 and snap into engagement with the flange 6, see FIG. 7.

A gasket 13 having a low thermal conductivity is applied on the end of the annular flange 6 and runs along the entire circumference of the flange 6, so that the tabs 12 engage the flange 6 via the gasket 13. A resilient gasket 14 of O-shaped cross-section also having a low thermal conductivity is applied on the inner side of the front wall 4 of the exterior housing section 2 and runs along the annular flange 11 of the interior housing section 3. The gasket 14 is provided with an adhesive on opposite sides to adhere to the flange 11 and the front wall 4. The tabs 12 are positioned on the side wall 10 such that the resilient gasket 14 is compressed somewhat when the tabs 12 abut against the gasket 13, whereby the housing sections 2 and 3 form a rigid unit. the gaskets 13 and 14 provides thermal breaks between the housing sections 2 and 3, which improves the insulation quality of the panel 1.

FIG. 5 shows a modification of the snap-in engagement means in the form of a protrusion 15, which projects outwardly from the side wall 10 of the interior housing section 3. The protrusion is formed by cutting a straight slot 16 in the side wall 10 and pressing the side wall 10 adjacent the slot 16 to form a curved wall portion with an edge, which is to abut against the gasket 13, when the horsing sections 2 and 3 are assembled.

FIG. 7 illustrates the assemblage of the panel 1 and a frame member 17 of a framework. The framework, not shown, is to be provided with number of panels according to the invention having different suitable sizes to form a closed rectangular cabinet, for accommodating the air handling equipment in question. The assemblage shown in FIG. 7 is applicable to all of the panels of the cabinet. The panels 1 are attached to the framework so that the front walls 4 of the exterior housing sections 2 of the panels 1 form external surfaces of the cabinet, while the front walls 4 of the interior housing sections 3 of the panels 1 face the interior of the cabinet.

The frame member 17 is profiled to fit the stepped shape of the panel 1, see FIG. 1, so that the front wall 4 of the exterior housing section 2 is flush with an outer surface 18 of the frame member 17. A rectangular projection 19 of the frame member 17 fits in the space formed by the annular flange 6 and the portion of the side wall 10 of the interior housing section 3 which extends outside of the chamber 7. The gasket 13 has a resilient tubular portion 20, which is located on the external side of the flange 6 and which is squeezed between the rectangular projection 19 of the frame member 17 and the flange 6, so that the gasket 13 abuts against the side wall 10 and seals between the latter and the flange 6. In FIG. 7, the tubular portion 20 in a non-squeezed state is indicated in broken lines. The panel 1 is connected to the frame member 17 by means of any suitable fastening means, not shown, such as screws, bolts, rivets or the like. For example, screws may extend through bores in the front wall 4 and the flange 6 of the exterior housing section 2 and be screwed into the rectangular projection 19 of the frame member 17.

The exterior and Interior housing sections 2,3 of the panel form a space, which is filled with a suitable insolation material 21, such as mineral wool, glass fibre insulation, foam insulation or the like.

Although the panel 1 has been described above as having a rectangular shape it may take any other suitable shape, such as triangular, trapezoidal or curved shape.

What is claimed is:

1. An insulation panel for cabinets containing air handling equipment, comprising:

a first housing section forming a chamber and having an annular flange defining an opening into said chamber, said flange having a side surface facing said chamber, a second housing section having a circumferential side wall extending through said opening into said chamber of said first housing section to form a space for insulation material between said first and second housing sections, a first gasket extending along said side surface of said annular flange of said first housing section, snap-in engagement means arranged on said circumferential side wall of said second housing section and adapted to snap engage with said side surface of said flange of said first housing section via said first gasket, when said circumferential side wall is inserted through said opening into said chamber, to join said first and second housing sections to each other, and a resilient second gasket arranged between said circumferential side wall of said second housing section and said first housing section, wherein said circumferential side wall abuts against said second gasket to somewhat compress the latter, whereby said snap-in engagement means abut against said first gasket under some pressure so that said first and second housing sections form a rigid unit.

2. An insulation panel according to claim 1, wherein said first housing section comprises a planar first front wall and a circumferential side wall extending substantially perpendicular to said first front wall, said annular flange extending inwardly from said side wall in parallel with said planar first front wall, and said second housing section comprises a planar second front wall, said circumferential side wall of said second housing section extending substantially perpendicular to said planar second front wall.

3. An insulation panel according to claim 2, wherein said circumferential side wall of said second housing section abuts against said first front wall of said first housing section via said resilient second gasket.

4. An insulation panel according to claim 3, wherein said resilient second gasket is provided with an adhesive for adhering to said first front wall of said first housing section and said circumferential side wall of said second housing section.

5. An insulation panel according to claim 1, wherein said snap-in engagement means comprise a plurality of snap-in engagement members distributed around said circumferential side wall of said second housing section.

6. An insulation panel according to claim 5, wherein each snap-in engagement member comprises a tab which extends outwardly from said circumferential side wall of said second housing section.

7. An insulation panel according to claim 5, wherein said circumferential side wall of said second housing section is made of a metal sheet, each tab being formed by a U-shaped cut-out in said metal sheet.

8. An insulation panel according to claim 5, wherein each snap-in engagement member comprises a protrusion projecting outwardly from said circumferential side wall of said second housing section.

9. An insulation panel according to claim 8, wherein said circumferential side wall of said second housing section is made of a metal sheet, said protrusion being formed by pressing said metal sheet.

* * * * *